US005123806A

United States Patent [19]

Pankowiecki

[11] Patent Number: 5,123,806

[45] Date of Patent: Jun. 23, 1992

[54] OIL COOLER TUBE BUNDLE POSITIONING DEVICE

[75] Inventor: Joseph Pankowiecki, Casselberry, Fla.

[73] Assignee: Westinghouse Electric Corp., Pittsburgh, Pa.

[21] Appl. No.: 597,915

[22] Filed: Oct. 10, 1990

[51] Int. Cl.[5] ..... B66C 1/66

[52] U.S. Cl. ..... 414/745.3; 294/67.33; 414/626; 414/783; 414/786; 414/908; 414/910

[58] Field of Search ..... 294/67.22, 67.3, 67.33, 294/906; 414/786, 745.3, 908, 910, 783, 626; 211/125

[56] References Cited

U.S. PATENT DOCUMENTS

| | | | |
|---|---|---|---|
| 2,390,293 | 12/1945 | Colson | 414/783 X |
| 3,687,300 | 8/1972 | Andersson | 414/783 |
| 3,908,845 | 9/1975 | Bolt | 414/910 X |
| 3,958,698 | 5/1976 | van der Woerd | 414/745.3 |
| 4,430,040 | 2/1984 | Halmos | 414/783 |
| 4,797,248 | 1/1989 | Tsitsichvili | 294/906 X |

FOREIGN PATENT DOCUMENTS

| | | | |
|---|---|---|---|
| 2841963 | 3/1980 | Fed. Rep. of Germany | 414/783 |
| 1426927 | 9/1988 | U.S.S.R. | 294/67.3 |

*Primary Examiner*—Robert J. Spar
*Assistant Examiner*—Janice Krizek

[57] ABSTRACT

An oil tube bundle positioning device (26) for supporting and restraining oil cooler tube bundles (10) so that they can be safely oriented from one position to another, e.g., from a vertical position to a horizontal position, for cleaning and servicing. The positioning device (26) includes a substantially rigid beam element (28), a first plate (30) fixed to the beam element (28) and a second plate (32) movably supported by the beam element (28) and spaced from the first plate (30). The positioning device is designed to receive an oil tube bundle (10) in the spacing between the first and second plates (30, 32). A plurality of tapered dowels (42) extend from each of the first and second plates (30, 32). Each dowel (42) is positioned to engage an end of a tube (14) of the tube bundle (10) upon the tube bundle (10) being received between the first and second plates (30, 32). At least one restraining strap (40), adapted to encircle the periphery of a tube bundle (10) received between the first and second plates (30, 32) is fixed to the beam element (28) at a position intermediate the first and second plates (30, 32).

10 Claims, 4 Drawing Sheets

OIL COOLER TUBE BUNDLE POSITIONING DEVICE

BACKGROUND OF THE INVENTION

The present invention relates to an oil cooler tube bundle positioning device for supporting and restraining an oil cooler tube bundle so that it can be safely oriented from one position to another, e.g., from a vertical position to a horizontal position for cleaning, servicing or storing.

FIG. 1 illustrates a typical shell and tube heat exchanger 9 used for a conventional turbine generator lubrication oil system. The illustrated heat exchanger 9 includes a first tube bundle 10 and a first cooler shell 12. Tube bundle 10 is configured to be inserted into cooler shell 12. Heat exchanger 9 also includes a second cooler shell 13 in which a second tube bundle (not shown) is disposed.

Each tube bundle 10 includes a plurality of straight tubes 14 through which a cooling fluid (not shown) flows when heat exchanger 9 is operating to cool oil. The opposed ends of each tube 14 are fixed to an inlet tube sheet 16 and reverse tube sheet 18, respectively. A plurality of baffle plates 20 are distributed along the length of tube bundle 10 and are fixed to each other, but not to tubes 14, by a plurality of tie rods (not shown). Oil to be cooled flows into cooler shells 12 and 13 through an inlet (not shown) near the lower ends (with respect to FIG. 1) of each shell. The oil flows around baffle plates 20 and tubes 14 before exiting shells 12 and 13 through an outlet (not shown).

Tube bundle dimensions vary for different lubrication oil systems. However, a length of 700 cm. and a diameter of 80 cm. can be considered representative of the dimensions of a typical tube bundle. It will be appreciated that the present invention is not restricted to specific tube bundle dimensions.

The tube bundle structure described above is relatively flexible in the directions other than the axial direction of the tube bundle. Due to this flexibility and the relatively large size of a typical tube bundle, handling and orienting the tube bundle structure (e.g., during servicing or cleaning) has heretofore been difficult and cumbersome.

It is the current practice to attach a lifting eye 24 to inlet tube sheet 16 to pull tube bundle 10 from shell 12, vertically, for servicing. Tube bundles are usually serviced, cleaned, and stored in a horizontal position. However, heretofore no specific apparatus were provided for easily transferring a tube bundle from vertical to horizontal orientations to permit the bundle to be laid horizontally onto suitable supports. Past attempts at manipulating the typically cumbersome tube bundles from vertical to horizontal orientations have often resulted in damage to the tube bundles.

SUMMARY OF THE INVENTION

It is an object of the present invention to provide a method and apparatus for supporting and orienting a tube bundle which overcomes such past problems, as discussed above, associated with transferring or reorienting tube bundles.

It is also an object of the present invention to provide a method and apparatus for securely restraining the ends of a tube bundle as well as providing intermediate support of the tube bundle to permit orientation of the tube bundle in any position.

According to an embodiment of the present invention, an oil tube bundle positioning device includes a substantially rigid beam element, a first plate fixed to the beam element and a second plate movably supported by the beam element and spaced from the first plate. The positioning device is designed to receive an oil tube bundle in the spacing between the first and second plates.

A plurality of tapered dowels extend from each of the first and second plates. Each dowel is positioned to engage an end of a tube of the tube bundle upon the tube bundle being received between the first and second plates. At least one restraining strap, adapted to encircle the periphery of a tube bundle received between the first and second plates, is fixed to the beam element at a position intermediate the first and second plates.

According to an embodiment of the present invention, an oil tube bundle is lifted vertically out of its casing or shell by well known lifting means. The tube bundle is then received, in a vertical orientation, between the first and second plates of a positioning device such as described above. Tapered dowels extending from the plates engage the ends of the tubes of the tube bundle and the strap is positioned around the periphery of the tube bundle. In this manner, the tube bundle is secured to the rigid beam element of the positioning device and is restrained from substantial flexing or movement. With the tube bundle thus secured, the positioning device and the tube bundle is lifted and transferred, as a unit, from a vertical orientation to a horizontal orientation by well known lifting means. According to the present invention, a tube bundle can be readily transferred from a vertical orientation to a horizontal orientation while avoiding handling and transportation problems associated with the inherent flexibility and the large size of typical oil cooler tube bundles.

DESCRIPTION OF THE PREFERRED EMBODIMENTS

Figure 2:
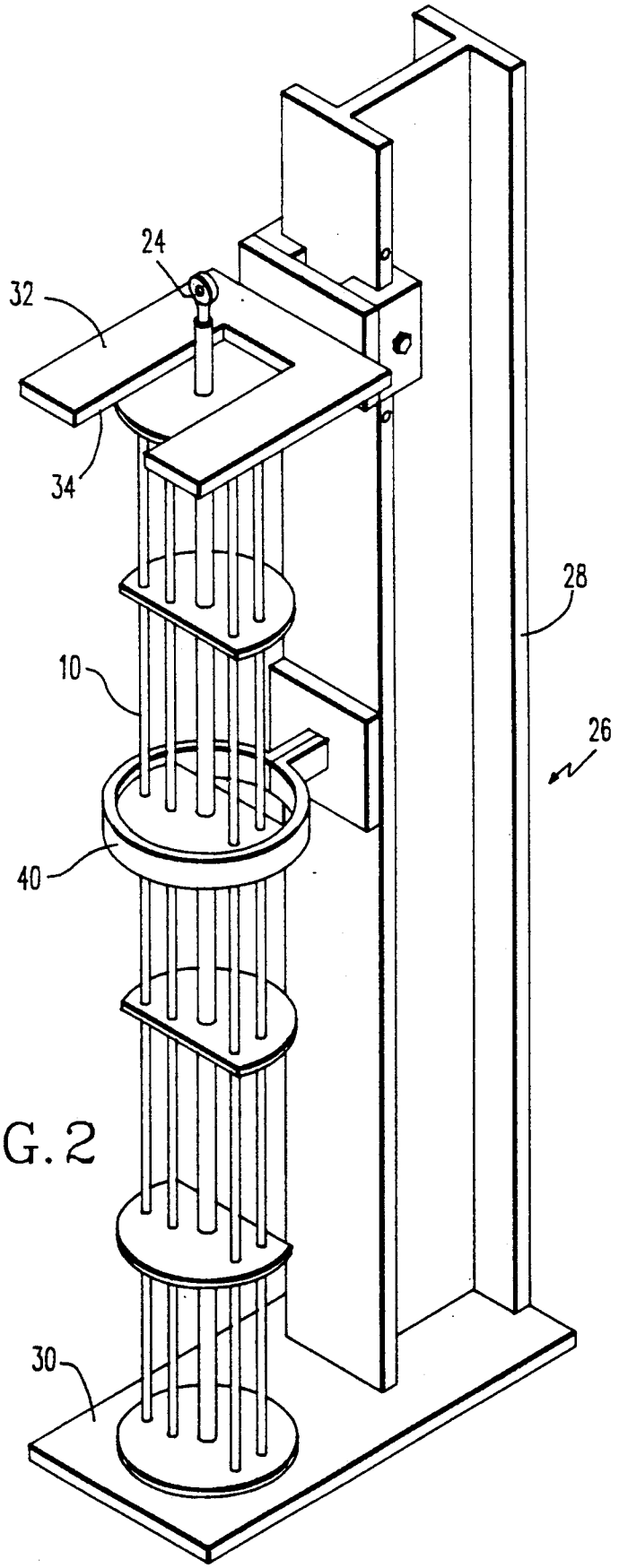
FIG. 2 is a perspective view of a positioning device according to an embodiment of the present invention.

FIG. 2 shows a positioning device 26 according to an embodiment of the present invention. Positioning device 26 includes a substantially rigid, elongate beam element 28 having an I-shaped cross section. However, it will be recognized that the present invention is not limited to a beam having any particular cross section shape. In a preferred embodiment, beam element 28 is provided with at least two lifting eyes, or other suitable structure, which can be connected to a cable, or the like, of a conventional lifting apparatus. In the illustrated embodiment, beam element 28 is provided with two of such lifting eyes 29 (see FIGS. 4A–4B).

A fixed end support plate 30 is fixed adjacent one end of beam element 28. A movable end support plate 32 is movably supported by beam element 28 in the manner described below and is movable along the length of beam element 28. Movable end support plate 32 has a central slot 34 through which tube bundle lifting hook 24 or a portion of a lifting device may extend, as will be described below.

Figure 2A:
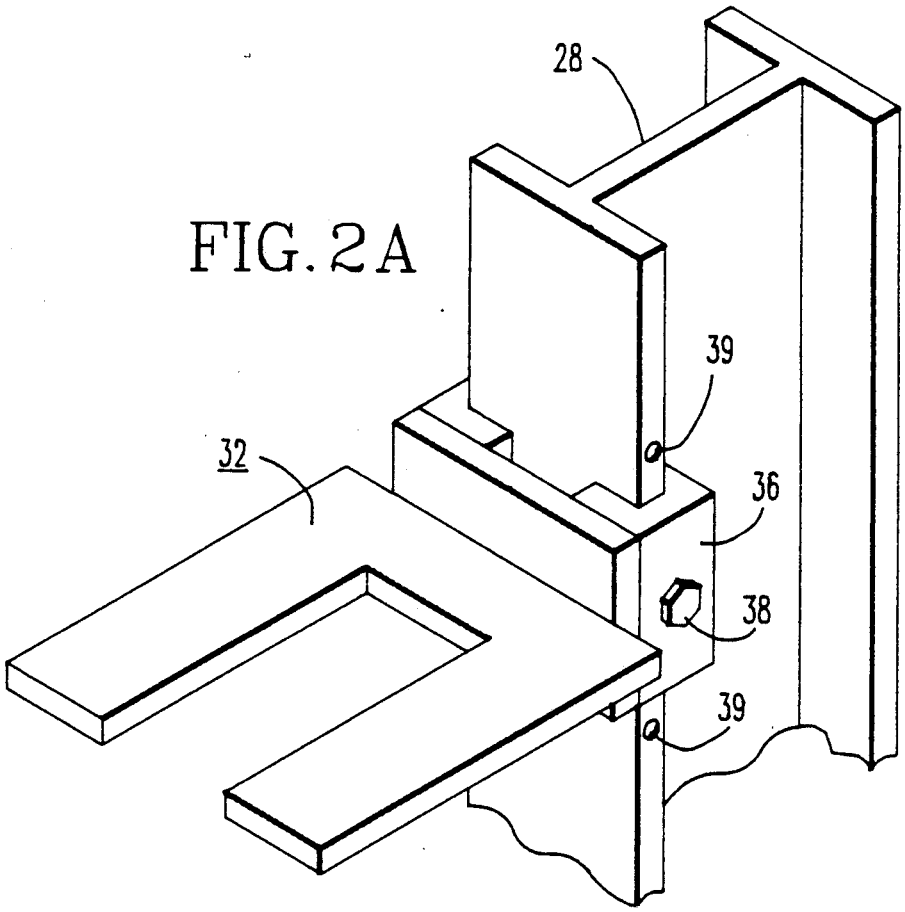
FIG. 2A is a detail view of a portion of FIG. 2.

Movable end support plate 32 is provided with a C-shaped bracket 36 and a locking bolt 38 (shown best in FIG. 2A). Bracket 36 and locking bolt 38 operate as a locking bracket capable of being secured to beam element 28 at any one of various locations along the length of beam element 28. In this manner, movable end support plate 32 is positionable at any one of various locations along the length of beam element 28.

Locking bolt 38 may operate, for example, by selectively extending through a hole in bracket 36 and into any one of several threaded bores 39 provided along the length of beam element 28. Alternatively, locking bolt 38 may operate by selectively frictionally engaging through bracket 36 with beam element 28. It will be appreciated, however, that a variety of types of movable brackets and locking assemblies may be employed without departing from the present invention.

The location of movable end support plate 32 along the length of beam element 28 can be altered to alter the relative distance between movable end support plate 32 and fixed end support plate 30. Upon placing tube bundle 10 between end support plates 30 and 32, movable end support plate 32 can be moved toward tube bundle 10 to closely interpose tube bundle 10 between end support plates 30 and 32. As will be apparent from the description below, the capability of altering the relative distance between movable end support plate 32 and fixed end support plate 30 allows positioning device 26 to accommodate various tube bundle lengths and facilitates the mounting and removal of a tube bundle with respect to the positioning device 26.

In a preferred embodiment, positioning device 26 includes one or more intermediate supports 40 for supporting a tube bundle at a position intermediate fixed and movable end support plates 30 and 32. Intermediate support 40 comprises a strap assembly fixed to beam element 28 and having a flexible strap adapted to encircle the circumference of tube bundle 10. Intermediate support 40 reduces sagging of tube bundle 10 which would otherwise result from the flexibility and weight of the tube bundle when the tube bundle is oriented horizontally.

Also in a preferred embodiment, fixed and moveable end support plates 30 and 32 are each provided with a plurality of tapered dowels 42. Dowels 42 extend from the respective end support plates 30 and 32 toward the space between end support plates 30 and 32. Dowels 42 are provided to engage with open ends of tubes 14 adjacent tube sheets 16 and 18 when tube bundle 10 is placed between end support plates 30 and 32 as shown in FIG. 2. Since dowels 42 extend from end support plate 30 in a similar manner as from end support plate 32, it will be recognized that the following description (with respect to FIG. 3) of dowels 42, spacers 48 and end support plate 30 can apply to dowels 42 and spacers 48 extending from end support plate 32 as well.

Figure 3:
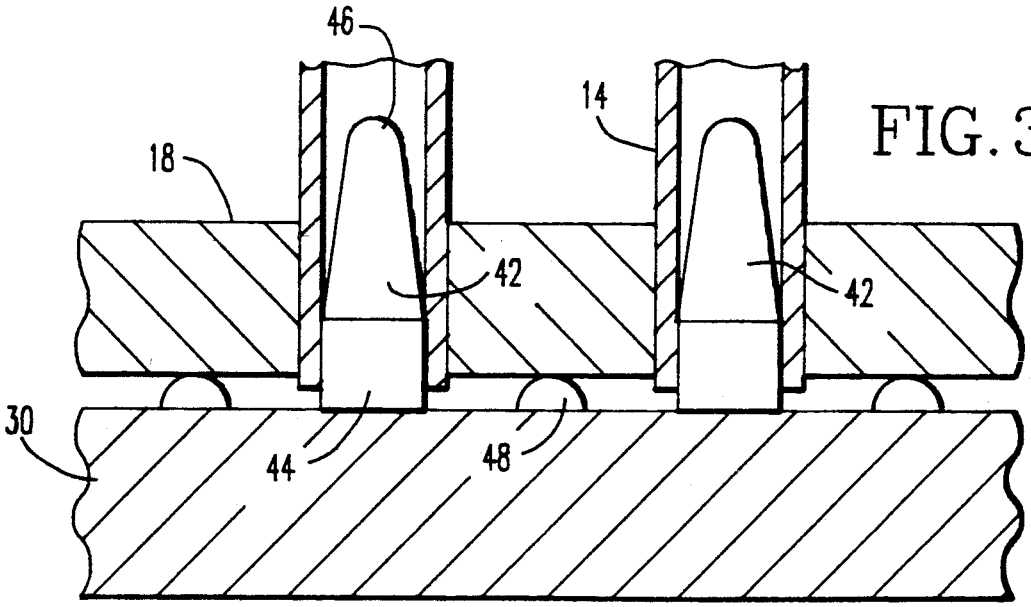
FIG. 3 is a cross-sectional side view of a portion of a tube bundle mounted on a positioning device according to an embodiment of the present invention.

FIG. 3 illustrates a portion of end support plate 30, tapered dowels 42, tubes 14, tube sheet 18, and tube sheet support spacers or projections 48. As mentioned above, end support plate 32 is provided with similar dowels 42 and spacers or projections 48. As shown in FIG. 3, tapered dowels 42 extend from locations of end support 30 that coincide with the geometric tube pattern (which may be a standard pattern) of tube bundle 10, such that each end of each tube 14 of the tube bundle is engaged by a dowel 42 upon the tube bundle being received between end support plates 30 and 32. Upon engagement of dowels 42 and tubes 14, each engaged dowel 42 extends partially into the interior of a tube 14.

In the embodiment illustrated in FIG. 3, dowels 42 extending from end support plate 30 have a tapered configuration, wherein each dowel has a wide portion 44 adjacent end support plate 30 and a tapered portion (tapering to a reduced width) extending from wide portion 44 to the free end 46 of the dowel. Preferably, the free end 46 of each dowel 42 has an outside diameter which is smaller than the inside diameter of tubes 14. In this manner, each dowel 42 extends at least partially into an open end of a tube 14 when tube bundle 10 is placed between end support plates 30 and 32.

The tapered dowels 42, when engaging and extending into tubes 14, firmly restrain tube bundle 10 from movement in the direction transverse to the axial centerline of tube bundle 10. When movable end support plate 32 is lowered (with respect to FIG. 2) onto tube bundle 10 and locked against beam element 28, end support plates 30 and 32 restrain tube bundle 10 from movement in the axial direction of the tube bundle.

It is common for tubes 14 of a tube bundle 10 to project through tube sheets 16 and 18 by variable amounts. Accordingly, tube sheet support spacers or projections 48 are provided to ensure that tube sheets 18 and 16 are spaced apart from plates 30 and 32, respectively, and to prevent the ends of tubes 14 from contacting plates 30 and 32. In the FIG. 3 embodiment, end support plate 30 is provided with a plurality of rounded projections 48 which are designed to contact tube sheet 18 and maintain tube sheet 18 at a specified distance from end support plate 30. Similarly, end support plate 32 may be provided with rounded projections 48 designed to contact tube sheet 16 and maintain tube sheet 16 at a specified distance from end support plate 32. In this manner, spacers or projections 48 prevent damage to individual tubes 14 and to tube bundle 10 which could otherwise occur if end support plates 30 and 32 directly contact tubes 14. Preferably, spacers or projections 48 are positioned to coincide with locations intermediate to tubes 14 of the tube pattern, as shown in FIG. 3.

Figure 1:
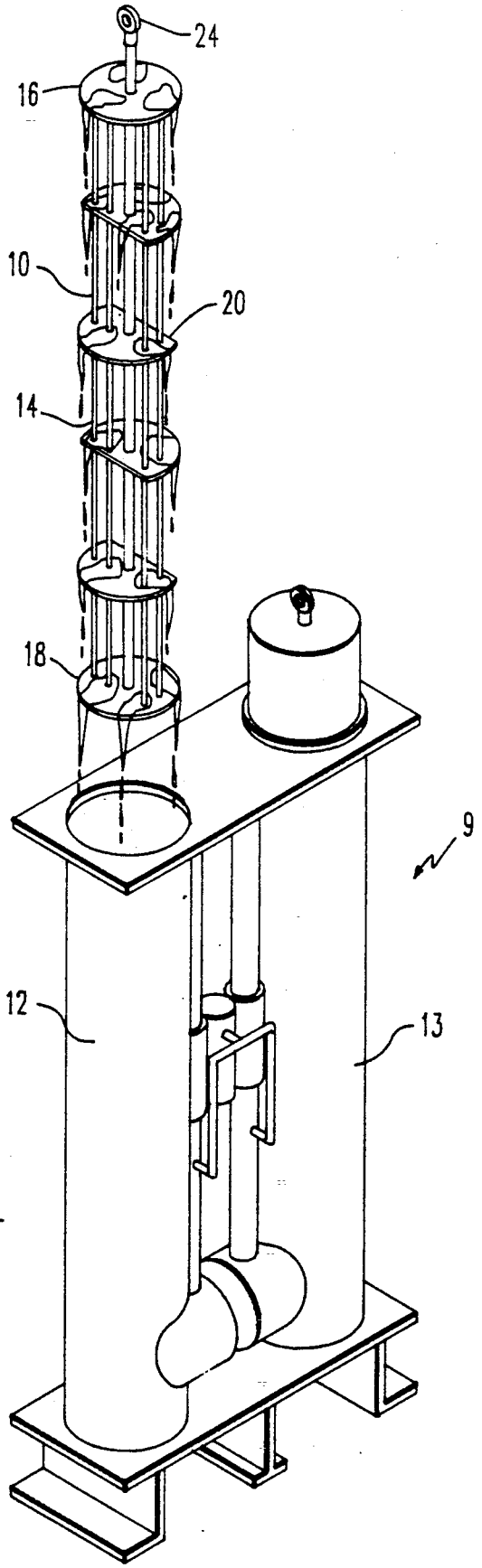
FIG. 1 PRIOR ART
FIG. 1 is a perspective view of a conventional shell and tube heat exchanger, wherein a tube bundle is removed from a shell.
Figure 4A:
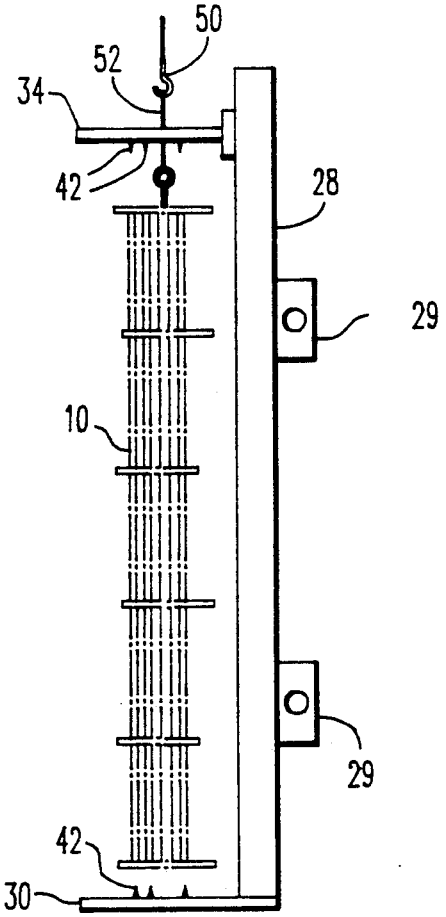
FIGS. 4A–4C are side views of a tube bundle and a positioning device showing three stages in a method of orienting the tube bundle with the positioning device, according to an embodiment of the present invention.
Figure 4B:
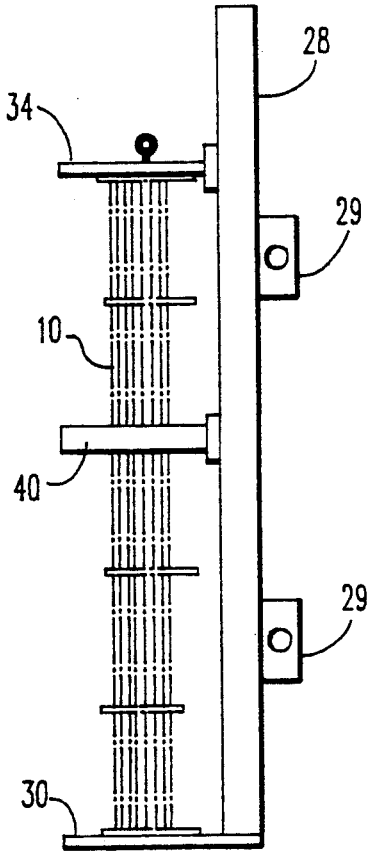
Figure 4C:
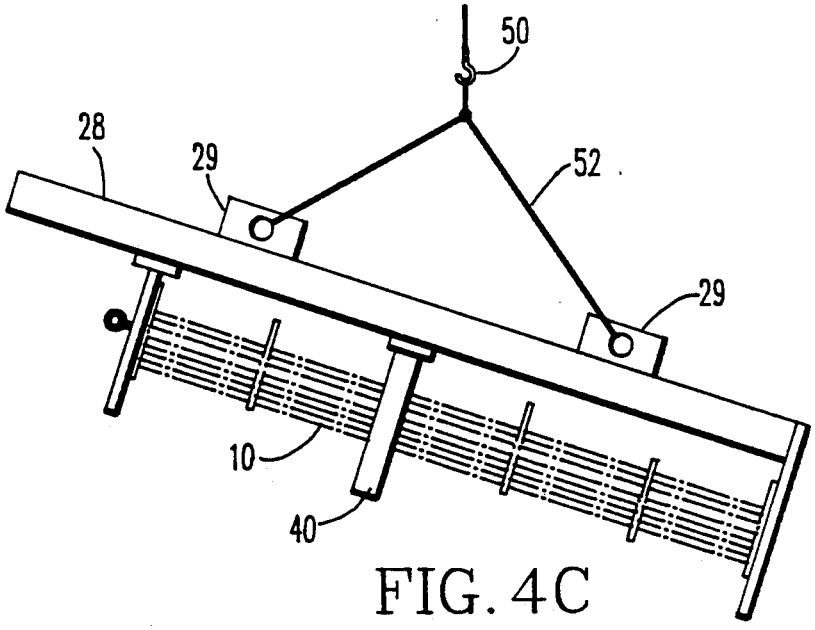

FIGS. 4A to 4C illustrate a sequential method of operating the above described positioning device 26. According to this method, an oil cooler tube bundle 10 is withdrawn vertically from a cooler shell 12 in the conventional manner, e.g., by connecting hook 50 of a conventional lifting device (not shown) to lifting eye 24 and by lifting tube bundle 10 out of shell 12 as shown in FIG. 1. Tube bundle 10 can remain in a substantially vertical position (i.e., the central axis of tube bundle 10 can remain vertical) as the tube bundle is withdrawn from shell 12.

Tube bundle 14 is then positioned substantially vertically between end support plates 30 and 32, with lifting eye 24 (and/or hook 50, cable 52 or other portions of a lifting device) extending through slot 34 of movable end support plate 32, as shown in FIGS. 2 and 4A. Tube bundle 10 is positioned over fixed end support plate 30 to align tapered dowels 42 extending from end support plate 30 with tubes 14. Once aligned with dowels 42, tube bundle 10 is lowered until tube sheet 18 rests on tube sheet support spacers or projections 48.

Then, movable end support plate 32 is lowered into position so that tapered dowels 42 extending from end support plate 32 engage with tubes 14 and tube sheet support spacers or projections projecting from end support plate 32 are in contact with tube sheet 16. Movable end support plate 32 is then locked to beam element 28 by means of locking bolt assembly 38. Finally, one or more intermediate support straps 40 are fastened around tube bundle 10.

The resulting assembly, shown in FIG. 4B, firmly restrains tube bundle 10 in the axial direction of the tube bundle and in directions transverse to the axial direction. In particular, strap 40 restrains tube bundle 10 from movement in directions away from beam element 28, especially when positioning device 26 and tube bundle 10 are lifted and rotated as shown in FIG. 4C and as described below.

A conventional lifting apparatus can be connected, e.g., via hook 50, cable 52 and lifting eyes 29, to positioning device 26. Conventional lifting apparatus (e.g., pulley arrangements, cranes, and the like) can now be used to lift and rotate the complete assembly. Preferably, the complete assembly is rotated substantially 90 degrees to transfer tube bundle 10 from a substantially vertical orientation (with the central axis of tube bundle 10 arranged substantially vertical) to a substantially horizontal orientation (with the central axis of tube bundle 10 arranged substantially horizontal) as shown in FIG. 4C. Tube bundle 10 can then be serviced, cleaned or stored while in a horizontal orientation.

An oil cooler positioning device and method, according to the above described embodiments, can accommodate varying tube bundle lengths and diameters. Once a tube bundle is secured in the positioning device, conventional lifting techniques can be used for orienting and transporting the tube bundle without risking damage to individual tubes or the tube bundle. Moreover, the above described positioning device and method do not require modifications to be made to the tube bundle. Accordingly, the above described device and method can be employed with a variety of conventional tube bundles to safely and economically transfer each tube bundle from a substantially vertical position to a substantially horizontal position for servicing, cleaning or storing the tube bundle.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. A positioning device for transferring a tube bundle of an oil cooling system from a substantially vertical orientation to a substantially horizontal orientation, the tube bundle having a plurality of tubes, each tube having an axial dimension and two opposed ends, and two tube sheets, each tube sheet being fixed to all of the tubes at a respective opposed end of the tubes so that at least one of the tubes projects beyond at least one of the tub sheets, and the device comprising:

an elongate substantially rigid member;

a first plate fixed to said rigid member;

a second plate supported by said rigid member, said second plate being spaced apart from said first plate and defining a gap between said first and second plates in which the tube bundle is disposable;

retaining means comprising at least one dowel extending from at least one of said first and second plates and configured to engage in at least one tube of the tube bundle to restrain movement of the at least one tube transverse to the axial dimension for inhibiting the tube bundle from flexing upon the tube bundle being disposed in the gap between the first and second plates; and spacer means mounted on at least one of said first and second plates for contacting the at least one tube sheet of the tube bundle at a location between tubes in order to maintain a space between the end of the at least one tube which projects beyond the at least one tube sheet and the at least one of the first and second plates; wherein said substantially rigid member, said first and second plates and the tube bundle, when retained in the gap between said first and second plates, may be transferred as a unit from a substantially vertical orientation to a substantially horizontal orientation.

2. A device as claimed in claim 1, wherein said rigid member comprises a beam and wherein said device further comprises movable support means for supporting said second plate for movement with respect to and along the length of said beam.

3. A device as claimed in claim 1, wherein said at least one dowel is configured to partially extend into the tube with which it engages.

4. A device as claimed in claim 1, wherein said retaining means further comprises a strap attached to said rigid member and adapted to extend around the circumference of the tube bundle upon the tube bundle being disposed between said first and second plates.

5. A device as claimed in claim 1, wherein said retaining means comprises a plurality of dowels extending from at least one of said first and second plates, said plurality of dowels being configured to engage a corresponding plurality of tubes of the tube bundle.

6. A device as claimed in claim wherein said retaining means comprises:

a plurality of dowels extending from each of said first and second plates, said dowels being configured to engage a corresponding plurality of tubes of the tube bundle; and a strap attached to said rigid member and adapted to extend around the circumference of the tube bundle.

7. A device as claimed in claim 1, wherein said device is operable with a lifting apparatus, said device further comprising means for connecting the lifting apparatus to said rigid member.

8. A method for employing the device of claim 7 for transferring a tube bundle of an oil cooling system from a substantially vertical orientation to a substantially horizontal orientation, the method comprising the steps of:

arranging the tube bundle substantially vertically between the first and second plates;

connecting a lifting apparatus to the rigid member; and lifting and rotating the rigid member and the tube bundle, as a unit, with the lifting apparatus.

9. A device as claimed in claim 1, wherein said spacer means comprise a plurality of spacer elements mounted on each of said first and second plates, with each of said spacer elements projecting from the plate on which it is mounted toward the other one of said first and second plates.

10. A positioning device for transferring a tube bundle of an oil cooling system from a substantially vertical orientation to a substantially horizontal orientation, the tub ebundle having a plurality of tubes, each tube having two opposed ends, and two tube sheets, each tube sheet being fixed to all of the tubes at a respective opposed end of the tubes so that at least one of the tubes projects beyond at least one of the tube sheets, and the device comprising:

an elongate substantially rigid member having a beam length;

a first plate fixed to said rigid member;

a second plate movably supported by said rigid member, said second plate being spaced apart from said first plate and defining a gap between said first and second plates in which the tube bundle is disposable, said second plate being movable along the length of said rigid member to selectively increase or decrease the size of the gap between the first and second plates;

a first plurality of dowels extending from said first plate and configured to engage and partially extend into a corresponding plurality of ends of the tubes of the tube bundle upon the tube bundle being disposed between said first and second plates;

a second plurality of dowels extending from said second plate and configured to engage and partially extend into a corresponding plurality of ends of the tubes of the tube bundle upon the tube bundle being disposed between said first and second plates;

at least one strap fixed to said rigid member at a position intermediate said first and second plates, said strap being adapted to extend about the periphery of the tube bundle upon the tube bundle being disposed between said first and second plates to retain the tube bundle between said first and second plates; and spacer means mounted on at least one of said first and second plates for contacting the at least one tube sheet of the tube bundle at a location between tubes in order to maintain a space between the end of the at least one tube which projects beyond the at least one tube sheet and the at least one of the first and second plates;

wherein said substantially rigid member, said first and second plates, said dowels, said strap and tube bundle, when retained in the gap between said first and second plates, may be transferred as a unit from a substantially vertical orientation to a substantially horizontal orientation.

* * * * *